United States Patent [19]

Brückner et al.

[11] Patent Number: 4,966,314

[45] Date of Patent: Oct. 30, 1990

[54] SELF-SEALING REFRACTORY PARTS OF A REGULATING DEVICE FOR REGULATING THE FLOW OF MOLTEN METAL FROM A METALLURGICAL VESSEL

[75] Inventors: Raimund Brückner, Nidernhausen; José Gimpera, Wiesbaden, both of Fed. Rep. of Germany

[73] Assignee: Didier-Werke AG, Wiesbaden, Fed. Rep. of Germany

[21] Appl. No.: 388,473

[22] Filed: Aug. 2, 1989

[30] Foreign Application Priority Data

Aug. 2, 1988 [DE] Fed. Rep. of Germany ..... 3826245

[51] Int. Cl.[5] ..... B22D 41/08

[52] U.S. Cl. ..... 222/598; 222/597

[58] Field of Search ..... 222/598, 594, 599, 597; 266/236

[56] References Cited

FOREIGN PATENT DOCUMENTS

| | | | |
|---|---|---|---|
| 0302215 | 2/1989 | European Pat. Off. | 222/599 |
| 0308597 | 3/1989 | European Pat. Off. | 222/598 |
| 1072995 | 2/1984 | U.S.S.R. | 222/599 |

*Primary Examiner*—S. Kastler

*Attorney, Agent, or Firm*—Wenderoth, Lind & Ponack

[57] ABSTRACT

The present invention is drawn to a regulating device of a metallurgical vessel for regulating the flow of molten metal from the vessel. The device includes a fixed refractory part defining a first cylindrical peripheral surface of the device and a movable refractory part that is rotatable and/or slidable relative to the fixed refractory part and defines a second cylindrical peripheral surface sealingly engaged with the first cylindrical peripheral surface. An actuating device is connected to the movable refractory part for rotating and/or sliding the movable refractory part relative to the fixed refractory part. The cylindrical peripheral surfaces of the refractory parts are spaced apart from one another so as to define an annular gap therebetween. In order to ensure that during operation the refractory parts can be moved relative to one another by the actuating device while preventing the penetration of molten metal into the annular gap, each of the refractory parts has a coefficient of thermal expansion which, when the device is subjected to a high temperature corresponding to the melting temperature of a molten metal, causes a clearance fit to be established between the peripheral surfaces that is effective to prevent molten metal having a melting point at the same predetermined high temperature from penetrating between the peripheral sealing surfaces while allowing the movable refractory part to be moved relative to the fixed refractory part.

19 Claims, 2 Drawing Sheets

SELF-SEALING REFRACTORY PARTS OF A REGULATING DEVICE FOR REGULATING THE FLOW OF MOLTEN METAL FROM A METALLURGICAL VESSEL

BACKGROUND OF THE INVENTION

The present invention relates to a regulating device for regulating the flow of molten metal from a metallurgical vessel wherein the device comprises a fixed refractory part and a rotatable and/or slidable movable refractory part which define cylindrical peripheral surfaces sealingly engaged with one another. The refractory parts typically comprise ceramics. However, the refractory parts may also be metallic or comprise composite materials. It is only necessary that such parts be fireproof, i.e. that they not only resist mechanically and chemically induced stresses during use but also resist stress induced by the high temperature of the molten metal with which the regulating devices are used.

Regulating devices include the one disclosed in DE-PS 35 40 202, and are characterized by the fact that they do not employ a compression device for pressing the relatively movable refractory parts together to establish an. air-tight clearance fit which prevents the penetration of molten metal. In these prior art devices it is possible, on the one hand, to actuate the regulating device with a relatively low drive force and, on the other hand, to dispose the refractory parts within the metallurgical vessel at a location at which the parts are submerged in molten metal during use. Therefore, with such a device, air is prevented from penetrating the regulating device and, in particular, air will not pass into the molten metal from the refractory parts during use.

In such a regulating device, the dimensions of an annular gap defined between the cylindrical peripheral sealing surfaces of the refractory parts is of decisive importance with respect to a satisfactory operation and life of the device. The annular gap must have dimensions which, on the one hand, allow the refractory parts to move freely relative to one another and, on the other hand, establish a tight enough clearance fit to prevent molten metal from penetrating into the annular gap. In this respect, other metallurgical parameters such as the composition of the molten metal, the wettability of the refractory parts, the temperature of the molten metal, etc. also play a role.

SUMMARY OF THE INVENTION

It is an object of the present invention to provide a regulating device of a metallurgical vessel which operates satisfactorily while enjoying a relatively long life by solving a problem relating to establishing a suitable width of an annular gap defined between peripheral sealing surfaces defined by refractory parts of the device.

More specifically, it is an object of the present invention to provide refractory parts of a regulating device of a metallurgical vessel which have coefficients of thermal expansion which, during use of the device, contribute to the establishment of a clearance fit between peripheral sealing surfaces of the device which is effective to prevent molten metal from penetrating between the surfaces while allowing the refractory parts to be moved between a discharge position at which molten metal is discharged from the metallurgical vessel through the device and a sealed position which restricts the discharge of molten metal.

According to the present invention, by sizing the annular gap between the peripheral sealing surfaces of the refractory parts based on the coefficients of thermal expansion of these parts wherein the width of the annular gap changes with a change in temperature, it is possible to design the dimensions of the annual gap at room temperature in such a manner that during the entire discharge operation, the free mobility of the two refractory parts relative to one another as well as an effective seal against the penetration of molten metal between the peripheral sealing surfaces are assured. Thus, the parts are self-sealing and do not require the compression device of the prior art.

In accordance with the specifics of the present invention, the coefficients of thermal expansion of the refractory parts are preferably identical. Thus, the same type of refractory parts may be used to constitute the movable and the fixed refractory parts which in turn makes the determination of the appropriate dimensions of the refractory parts, including those of the annular gap, easier. In addition, the fabrication of the regulating device is relatively easy.

Also, for facilitating the ease in manufacture of the present invention, the annular gap defined between the cylindrical peripheral surfaces has a constant width over the entire axial length of the surfaces.

Alternatively, it may be advantageous to limit the definition of the annular gap to only an area substantially just encompassing both the location at which a metal discharge opening of the device is open to the cylin- drical peripheral surfaces and that location at which the peripheral surfaces restrict molten metal from flowing from the metallurgical vessel through the molten metal discharge passage when the movable refractory part is at a sealed position. In such an embodiment, for example, it is possible to define a relatively large annular gap between the refractory parts and to provide a relatively narrow annular gap at the area described above that is effective to establish the clearance fit which prevents molten metal from penetrating between such surfaces at the area described above. Such a relatively narrow gap can be formed, for example, by applying a surface coating to one or both of the refractory parts at selected locations on the peripheral surfaces thereof.

For facilitating the most uniform expansion of the refractory parts during their use, and in view of facilitating the ease in manufacture of these parts, the refractory parts may be made tubular and cylindrical over the respective portions thereof at which the cylindrical peripheral sealing surfaces of the device are defined.

Based on molten metals which are conventionally poured from metallurgical vessels in practice, as well as on the materials available for fabricating the refractory parts of the regulating device according to the present invention, it has been found that an annular gap of between 0.05 mm and 0.7 mm at room temperature can be reduced upon the subjection of the device to a relatively high temperature corresponding to the pouring temperature at which the molten metal is to be poured, which establishes a clearance fit that prevents the same molten metal from penetrating between the surfaces during pouring.

Further objects, features and advantages of the present invention will become apparent to those of ordinary skill in the art from reviewing the detailed description of the preferred embodiments of the present invention below in conjunction with the accompanying drawings.

DETAILED DESCRIPTION OF THE PREFERRED EMBODIMENTS

Figure 2:
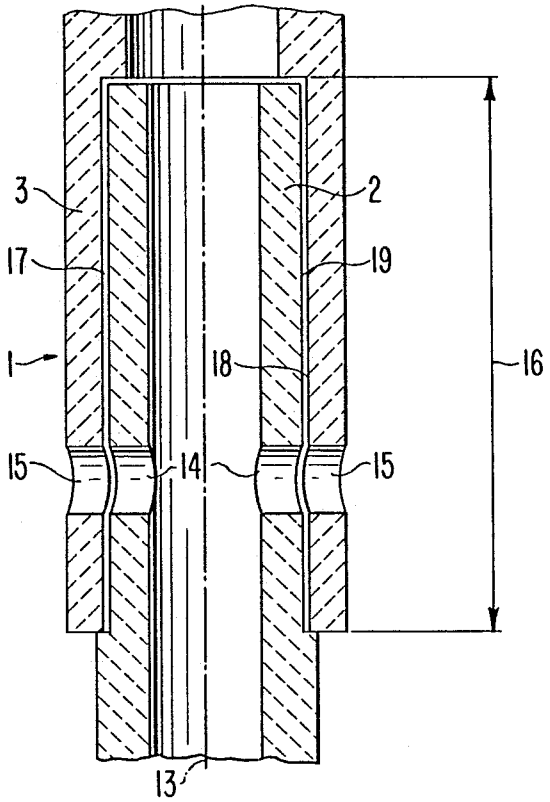
FIG. 2 is a detailed view showing a portion of the regulating device of FIG. 1 on an enlarged scale.

The regulating device 1 of the present invention comprises a tubular fixed refractory part 2 (stator) and a tubular movable refractory part 3 (rotor) each of which comprises ceramics.

The fixed refractory part 2 is secured to the tundish 5 in the refractory lining 4 thereof by mortar in an airtight and liquid-tight manner. The fixed refractory part 2 is open to an overflow nozzle 6 through which molten metal is discharged from the tundish 5.

The movable refractory part 3 is attached, in a swivel-proof manner, by bolt 7 to a holder 8. The holder 8, in turn, is connected to a drive arm 10 via a Cardan joint 9. The drive arm 10 is supported on a pedestal 11 of the tundish 5 and has, on the outer end thereof, a lever 12 which is manually operable to transmit a drive force to the movable refractory part of the regulating device 1 via the drive arm 10, the Cardan joint 9 and the holder 8 which constitute an actuating means for moving refractory part 3 in the device. Thus, the movable refractory part 3 can be rotated relative to the fixed refractory part 2 about the common longitudinal axis 13 in either of opposite rotational directions. In addition or alternatively, the actuating means for moving the movable refractory part 3 relative to the fixed refractory part 2 can be designed to slide the movable refractory part 3 relative to the fixed refractory part 2 along the common longitudinal axis 13.

As shown in FIG. 2, the refractory parts 2, 3 define first 17 and second 18 cylindrical peripheral surfaces of the device which confront one another. Further, the refractory parts 2, 3 define a molten metal discharge passage which is open to the confronting peripheral surfaces 17, 18 of the refractory parts and to the exterior of the metallurgical vessel via overflow nozzle 6. The molten metal discharge passage includes through-holes 14 extending diametrically opposite to one another in the fixed refractory part 2 and through-holes 15 extending diametrically opposite to one another within the movable refractory part 3. The movable refractory part 3 is shown in the discharge position at which the axial through-holes 14, 15 are aligned with one another. It will be readily apparent that the movable refractory part 3 can be slid or rotated relative to fixed refractory part 2 from the position shown in FIG. 2 to a sealed position at which portions of the confronting surfaces 17, 18, e.g. portions located between the through-holes 14, 15, restrict (stop or reduce) the flow of molten metal from the metallurgical vessel.

Figure 3:
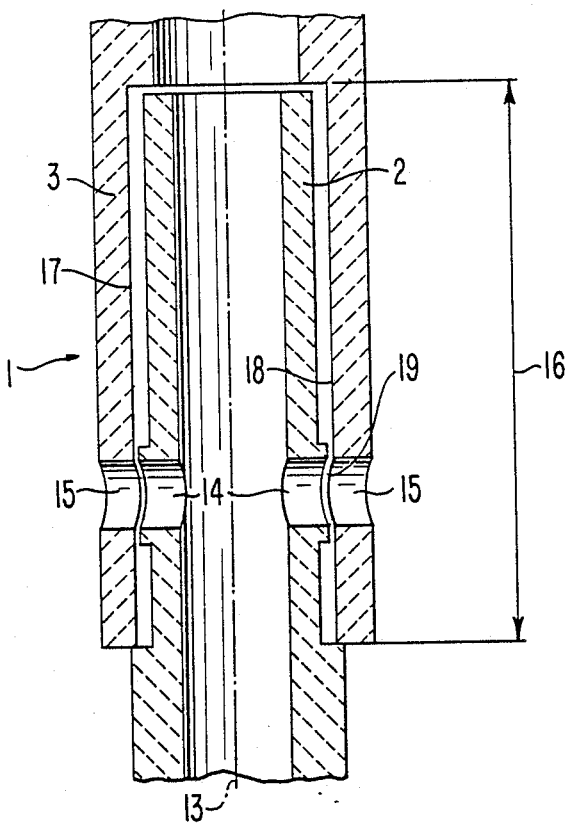
FIG. 3 is a view similar to that of FIG. 2 but showing a modified form of the present invention.

The peripheral surfaces 17, 18 of the refractory part are spaced apart from one another a predetermined distance so that an annular gap 19 is defined therebetween. In FIG. 2, the gap is shown to extend over the entire axial length 16 of the cylindrical surfaces 17, 18. In FIG. 3, the gap 19 is defined only in an area substantially just encompassing both the location at which a metal discharge opening of the device is open to the cylindrical peripheral surfaces and that location at which the peripheral surfaces restrict molten metal from flowing from the metallurgical vessel through the molten metal discharge passage when the movable refractory part is at a sealed position.

In a preferred embodiment of the present invention, except in the area along the axial dimension 16, the outer diameter of the fixed refractory part 2 is about 73 mm while the outer diameter of the movable refractory part 3 is about 93 mm. The inner diameter of the fixed refractory part 2 is approximately 33 mm while the inner diameter of the movable refractory part 3 is approximately 40 mm.

In the area within the axial dimension 16, the median diameter of the annual gap 19 is about 63 mm.

The refractory parts 2, 3 comprise a high alumina refractory material having the following composition:

| | |
|---|---|
| $Al_2O_3$ | approximately 70% by weight |
| zirconium mullite | approximately 20% by weight |
| carbon | approximately 10% by weight |

Since both refractory parts 2, 3 comprise the material above, the parts have the same coefficients of thermal expansion.

The diameters of the sealing surfaces 17, 18 are selected such that the diameters differ by about 0.4 mm at room temperature. Therefore, the annular gap 19 defined between the sealing surfaces 17, 18 has a width of about 0.2 mm.

A graphite containing lubricant is applied to the refractory parts 2, 3 whereby the sealing surfaces 17, 18 have diameters that only actually differ by about 0.25 mm. Thus, the annular gap 19 has a width of only about 0.125 mm.

The preferred embodiment described above was tested in a tundish 4 at room temperature, and in such a state, the drive arm 10 could be easily manipulated to rotate the movable refractory par 3 relative to the fixed refractory part 2.

Figure 1:
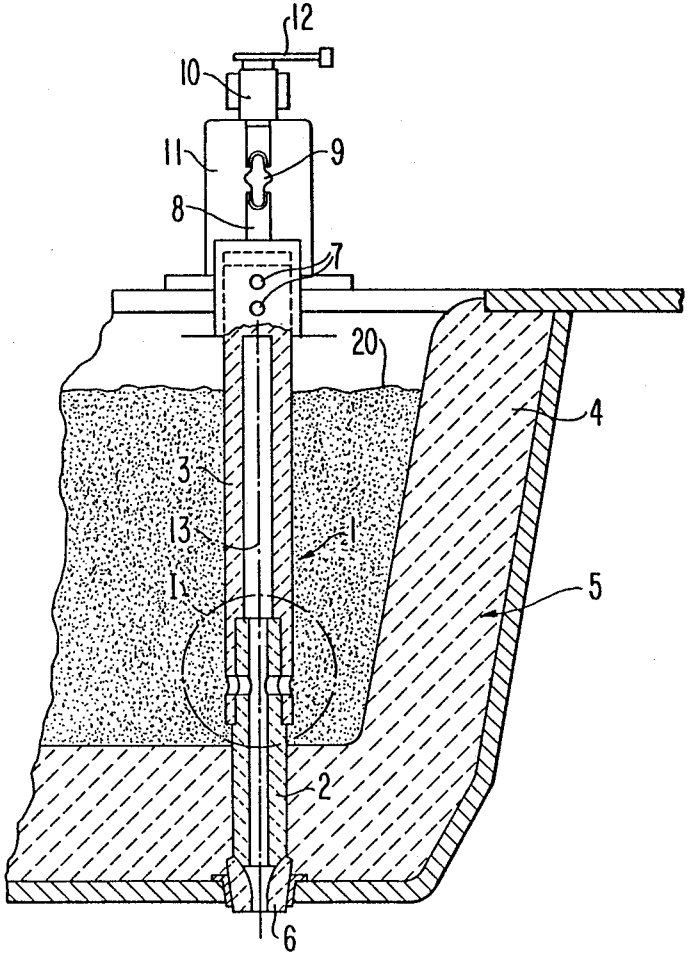
FIG. 1 is a partial sectional view of a regulating device of a metallurgical vessel for regulating the flow of molten metal from the vessel, the vessel being a tundish and only being partially illustrated.

Subsequently, the fixed refractory part 2 and the movable refractory part 3 were uniformly preheated to a temperature of about 950° C. Then, the tundish was filled with molten steel to a level corresponding to that indicated by reference numeral 20 in FIG. 1.

During the test, the molten commercial steel was poured off at a temperature of about 1560° C. The movable refractory part 3 was rotated relative to the fixed refractory part 2 several times between discharge and sealed positions in order to more or less place the through-holes 14, 15 of the refractory parts into and out of alignment with one another to regulate the flow of molten metal from the tundish 5. The movable refractory part 3 was also rotated several times to a sealed position at which the through-holes 14, 15 were completely out of alignment to interrupt the discharge of molten steel from the tundish 5.

Overall, four pan batches were poured employing the regulating device 1, which required an operation time of about 4 hours. With each batch poured, the level 20 was only allowed to drop as far as the top of the axial dimension 16 over which the cylindrical surfaces confront each other whereby the peripheral surfaces 17, 18 remained submerged in the molten steel. In this manner, it was assured that outside air was not able to pass into the device 1 through the through-holes 14, 15 or pass into the annular gap 19.

It was noted over the entire test described above that it was easy to move the movable refractory part 3 relative to the fixed refractory part 2 manually via the drive arm 10 with little force.

After the above-described test was completed (4 hours of operation) the regulating device 1 was removed and the refractory parts 2, 3 were examined for possible metal infiltration. It was observed that no appreciable amounts of metal had infiltrated the annular gap 19 by passing between the peripheral surfaces 17, 18.

Thus, as can be appreciated from the description above, for a given particular application of the present invention, i.e. when the regulating device is to be used to regulate the flow of a particular molten metal to be poured at a known temperature, the dimensions and coefficients of thermal expansion of the refractory parts of the device can be specified so as to ensure ease in operability during use while preventing the harmful effects caused by the penetration of molten metal between peripheral surfaces 17, 18.

The present invention has been described above with respect to preferred embodiments thereof. Various other embodiments, changes and modifications in the present invention will become apparent to those of ordinary skill in the art. All such various embodiments, changes and modifications are seen to be within the true spirit and scope of the present invention as defined by the appended claims.

What is claimed is:

1. A regulating device of a metallurgical vessel for regulating the flow of molten metal from the vessel, said device comprising:

a fixed refractory part fixedly secured to the metallurgical vessel so as to be immovable relative thereto, said fixed refractory part defining a first cylindrical peripheral surface of the device;

a movable refractory part rotatably, slidably or both rotatably and slidably mounted to the metallurgical vessel so as to be rotatable, slidable or both rotatable and slidable relative to said fixed refractory part, said movable refractory part defining a second cylindrical peripheral surface of the device confronting said first cylindrical peripheral surface;

said refractory parts defining a molten metal discharge passage open to the confronting peripheral surfaces of said refractory parts and to the exterior of metallurgical vessel; and actuating means connected to said movable refractory part for rotating, sliding or both rotating and sliding said movable refractory part relative to said fixed refractory part between a discharge position at which the molten metal discharge passage communicates with the interior of the metallurgical vessel to facilitate the discharge of molten metal from the vessel and a sealed position at which the flow of molten metal from the metallurgical vessel through the molten metal discharge passage is restricted by the confronting cylindrical peripheral surfaces defined by said refractory parts, said cylindrical peripheral surfaces of said refractory parts being spaced apart from one another a predetermined distance at room temperature so as to define an annular gap therebetween having a predetermined width at room temperature, and each of said refractory parts having a coefficient of thermal expansion which, when said device is subjected to a predetermined high temperature substantially above room temperature, causes a reduction in said predetermined width of the annular gap to a degree which establishes a clearance fit at said gap between said peripheral surfaces that is effective to prevent a molten metal having a temperature at said predetermined high temperature from penetrating between said surfaces at said gap while allowing said movable refractory part to be moved between said discharge and sealed positions by said actuating means.

2. A regulating device in a metallurgical vessel as claimed in claim 1, wherein the coefficient of thermal expansion of said refractory parts are identical.

3. A regulating device in a metallurgical vessel as claimed in claim 1, wherein the annular gap defined between said cylindrical peripheral surfaces has a constant width over the entire axial length of said surfaces.

4. A regulating device in a metallurgical vessel as claimed in claim 2, wherein the annular gap defined between said cylindrical peripheral surfaces has a constant width over the entire axial length of said surfaces.

5. A regulating device in a metallurgical vessel as claimed in claim 1, wherein the annular gap is defined between said cylindrical peripheral surfaces in only an area that substantially just encompasses both the location at which said metal discharge opening is open to said cylindrical peripheral surfaces and that location at which said peripheral surfaces restrict the flow of molten metal from the metallurgical vessel through the molten metal discharge passage when said movable refractory part is at said sealed position.

6. A regulating device in a metallurgical vessel as claimed in claim 2, wherein the annular gap is defined between said cylindrical peripheral surfaces in only an area that substantially just encompasses both the location at which said metal discharge opening is open to said cylindrical peripheral surfaces and that location at which said peripheral surfaces restrict the flow of molten metal from the metallurgical vessel through the molten metal discharge passage when said movable refractory part is at said sealed position.

7. A regulating device in a metallurgical vessel as claimed in claim 1, wherein said refractory parts are tubular and cylindrical over the respective portions thereof at which said cylindrical peripheral surfaces of the device are defined.

8. A regulating device in a metallurgical vessel as claimed in claim 1, wherein said predetermined width of said annular gap is between 0.05 mm and 0.7 mm at room temperature.

9. A regulating device in a metallurgical vessel as claimed in claim 1, wherein each of said refractory parts has a composition of

| | |
|---|---|
| $Al_2O_3$ | about 70% by weight |
| zirconium mullite | about 20% by weight |
| carbon | about 10% by weight |

and the width of the annular gap at room temperature is approximately 0.125 mm.

10. A regulating device in a metallurgical vessel as claimed in claim 1, wherein said actuating means is manually operable to transmit a force generated by an operator manipulating said actuating means to the movable refractory part.

11. A regulating device for use in a metallurgical vessel for regulating the flow of molten metal from the vessel, said device comprising:

a fixed refractory part fixedly securable to a metallurgical vessel so as to be immovable relative thereto, said fixed refractory part defining a first cylindrical peripheral surface of the device; and a movable refractory part rotatably, slidably or both rotatably and slidably mountable to a metallurgical vessel, said movable refractory part defining a second cylindrical peripheral surface of the device confronting said first cylindrical peripheral surface, said refractory parts defining a molten metal discharge passage extending therethrough and open to the confronting peripheral surfaces of said refractory parts, said movable refractory part being rotatable, slidable or both rotatable and slidable relative to said fixed refractory part between a discharge position at which a molten metal is flowable through the molten metal discharge passage and a sealed position at which the flow of the molten metal through the molten metal discharge passage is restricted, as compared to when the movable refractory part is at said discharge position, by the confronting cylindrical peripheral surfaces defined by said refractory parts, said cylindrical peripheral surfaces of said refractory parts being spaced apart from one another a predetermined distance at room temperature so as to define an annular gap therebetween having a predetermined width at room temperature, and each of said refractory parts having a coefficient of thermal expansion which, when said device is subjected to a predetermined high temperature substantially above room temperature, causes a reduction in said predetermined width of the annular gap to a degree which establishes a clearance fit at said gap between said peripheral surfaces that is effective to prevent a molten metal having a temperature at said predetermined high temperature from penetrating between said surfaces at said gap while allowing said movable refractory part to be moved between said discharge and sealed positions.

12. A regulating device for use in a metallurgical vessel as claimed in claim 11, wherein the coefficient of thermal expansion of said refractory parts are identical.

13. A regulating device for use in a metallurgical vessel as claimed in claim 11, wherein the annular gap defined between said cylindrical peripheral surfaces has a constant width over the entire axial length of said surfaces.

14. A regulating device for use in a metallurgical vessel as claimed in claim 12, wherein the annular gap defined between said cylindrical peripheral surfaces has a constant width over the entire axial length of said surfaces.

15. A regulating device for use in a metallurgical vessel as claimed in claim 11, wherein the annular gap is defined between said cylindrical peripheral surfaces in only an area that substantially just encompasses both the location at which said metal discharge opening is open to said cylindrical peripheral surfaces and that location at which said peripheral surfaces restrict the flow of molten metal through the molten metal discharge passage when said movable refractory part is at said sealed position.

16. A regulating device for use in a metallurgical vessel as claimed in claim 12, wherein the annular gap is defined between said cylindrical peripheral surfaces in only an area that substantially just encompasses both the location at which said metal discharge opening is open to said cylindrical peripheral surfaces and that location at which said peripheral surfaces restrict the flow of molten metal from the metallurgical vessel through the molten metal discharge passage when said movable refractory part is at said sealed position.

17. A regulating device for use in a metallurgical vessel as claimed in claim 11, wherein said refractory parts are tubular and cylindrical over the respective portions thereof at which said cylindrical peripheral surfaces of the device are defined.

18. A regulating device for use in a metallurgical vessel as claimed in claim 11, wherein said predetermined width of said annular gap is between 0.05 mm and 0.7 mm at room temperature.

19. A regulating device for use in a metallurgical vessel as claimed in claim 1, wherein each of said refractory parts has a composition of

| | |
|---|---|
| $Al_2O_3$ | about 70% by weight |
| zirconium mullite | about 20% by weight |
| carbon | about 10% by weight |

and the width of the annular gap at room temperature is approximately 0.125 mm.

* * * * *